United States Patent [19]

Kudoh

[11] Patent Number: 4,969,016

[45] Date of Patent: Nov. 6, 1990

[54] DEVICE APPLICABLE TO AN IMAGE RECORDING APPARATUS FOR FEEDING A ROLLED RECORDING MEDIUM

[75] Inventor: Kunio Kudoh, Yokohama, Japan

[73] Assignee: Ricoh Company, Ltd., Tokyo, Japan

[21] Appl. No.: 254,730

[22] Filed: Oct. 7, 1988

[30] Foreign Application Priority Data

Oct. 8, 1987 [JP] Japan ..... 62-254481

[51] Int. Cl.[5] ..... G03G 15/00; B65H 19/00

[52] U.S. Cl. ..... 355/310; 358/304; 83/342; 83/650; 83/360

[58] Field of Search ..... 355/309, 310, 311, 28, 355/29; 358/304; 83/341, 342, 346, 360, 650

[56] References Cited

U.S. PATENT DOCUMENTS 3,727,499 4/1973 Boston ..... 355/310 X 3,951,023 4/1973 Ashburner ..... 355/310 X

*Primary Examiner*—Joan H. Pendegrass

*Attorney, Agent, or Firm*—Oblon, Spivak, McClelland, Maier, & Neustadt

[57] ABSTRACT

A device installed in an imsge recording apparatus for pulling out the leading edge of a rolled recording medium such as a rolled paper and then cutting the recording medium at a predetermined length as measured from the leading edge to feed the resulting sheet to a predetermined recording section of the apparatus. A plurality of paper feed mechanisms are each provided with a cutter for cutting a paper which is paid out from a roll. When two or more of the paper feed mechanisms are loaded with a paper of a desired kind, they are automatically and repetitively switched from one to another every time a sheet feed operation is performed.

2 Claims, 21 Drawing Sheets

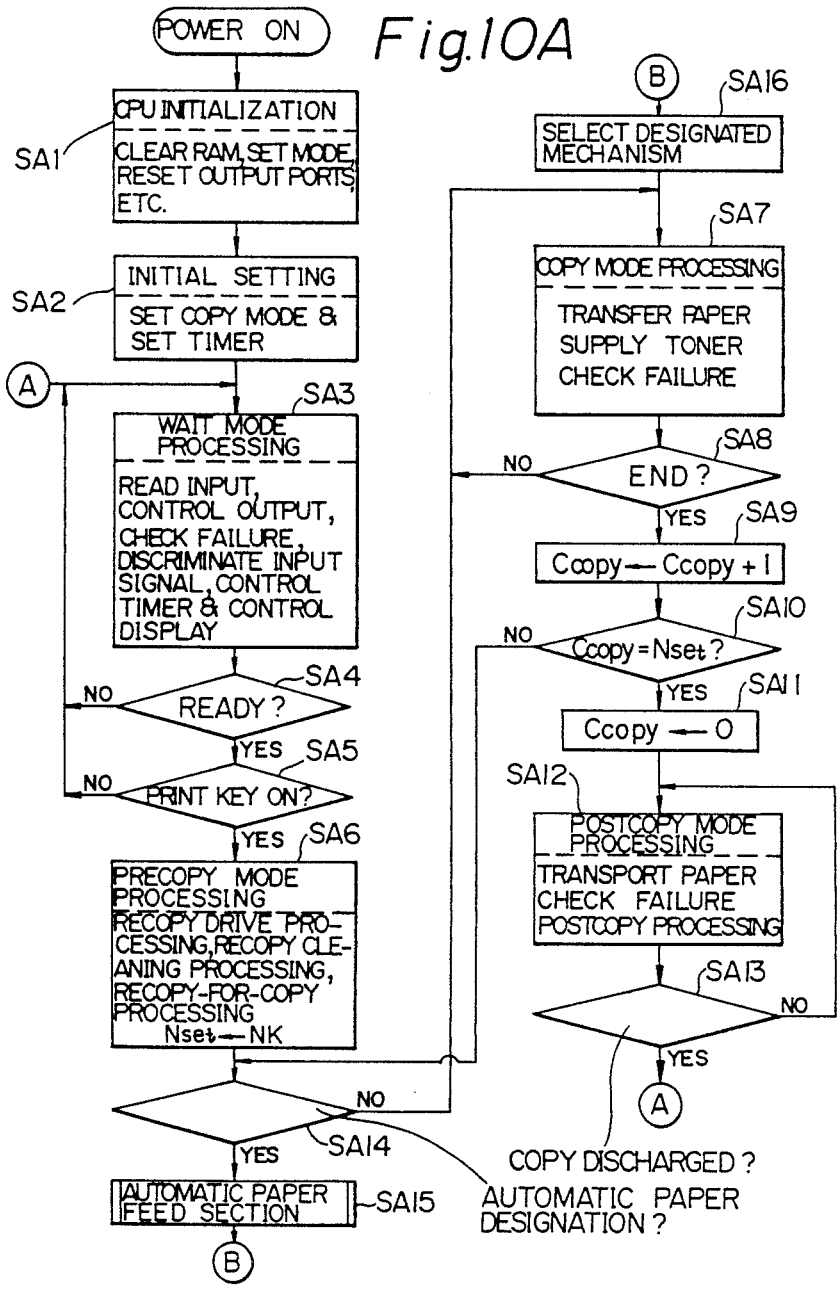
Fig.10A
POWER ON
CPU INITIALIZATION
CLEAR RAM, SET MODE, RESET OUTPUT PORTS, ETC.
SA1
INITIAL SETTING
SET COPY MODE & SET TIMER
SA2
A
WAIT MODE PROCESSING
READ INPUT, CONTROL OUTPUT, CHECK FAILURE, DISCRIMINATE INPUT SIGNAL, CONTROL TIMER & CONTROL DISPLAY
SA3
READY ?
SA4
NO
YES
PRINT KEY ON?
SA5
NO
YES
PRECOPY MODE PROCESSING
RECOPY DRIVE PROCESSING, RECOPY CLEANING PROCESSING, RECOPY-FOR-COPY PROCESSING
Nset ← NK
SA6
NO
YES
SA14
AUTOMATIC PAPER FEED SECTION
SA15
B
B
SELECT DESIGNATED MECHANISM
SA16
COPY MODE PROCESSING
TRANSFER PAPER
SUPPLY TONER
CHECK FAILURE
SA7
END ?
SA8
NO
YES
Ccopy ← Ccopy + 1
SA9
Ccopy = Nset ?
SA10
NO
YES
Ccopy ← 0
SA11
SA12
POSTCOPY MODE PROCESSING
TRANSPORT PAPER
CHECK FAILURE
POSTCOPY PROCESSING
SA13
NO
YES
A
COPY DISCHARGED ?
AUTOMATIC PAPER DESIGNATION ?

| Fig.10B-1 | Fig.10B-2 |
|---|---|

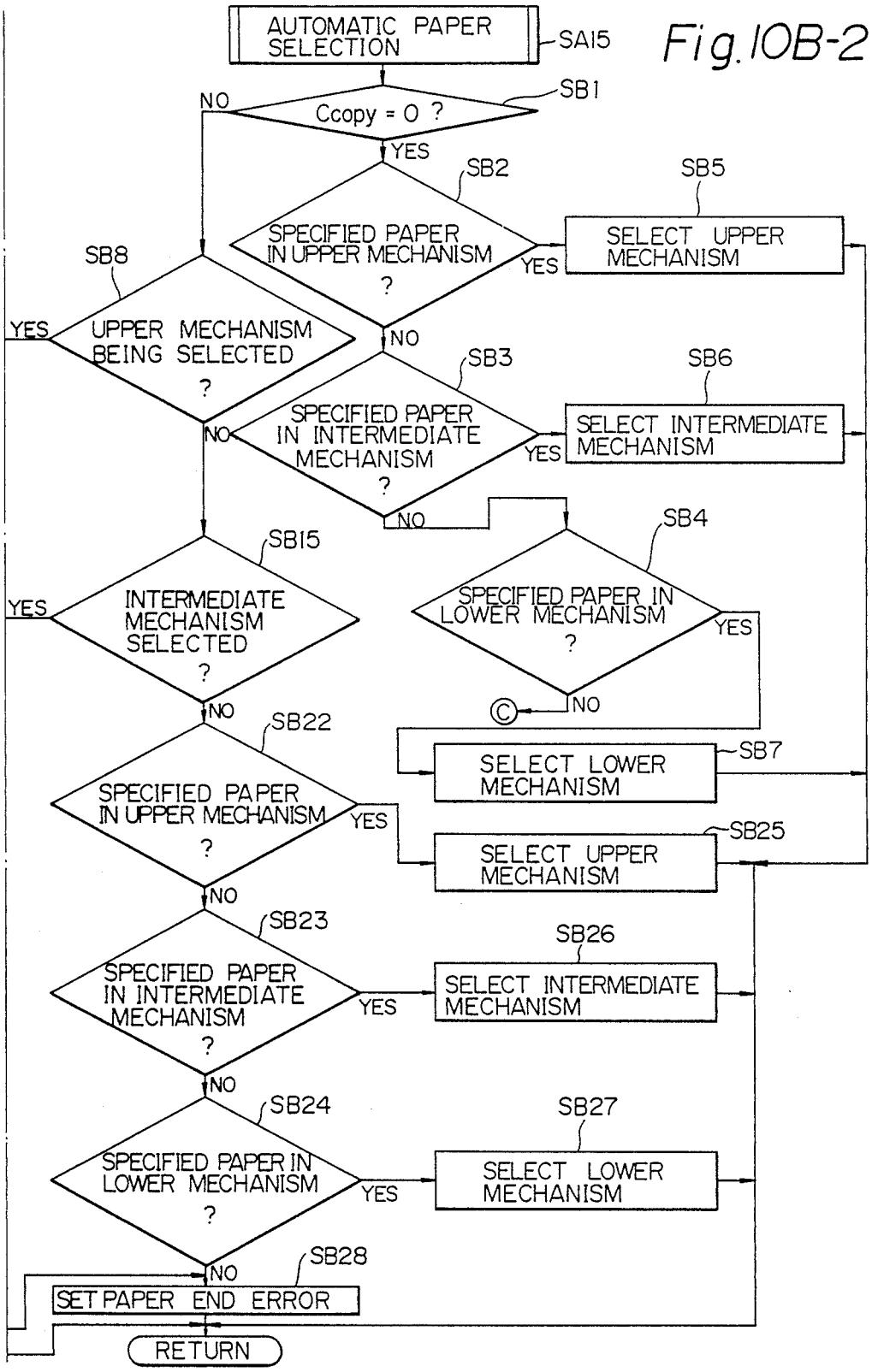
AUTOMATIC PAPER SELECTION
SA15
Fig. 10B-2
SB1
Ccopy = 0 ?
NO
YES
SB2
SPECIFIED PAPER IN UPPER MECHANISM ?
YES
SB5
SELECT UPPER MECHANISM
SB8
YES
UPPER MECHANISM BEING SELECTED ?
NO
SB3
SPECIFIED PAPER IN INTERMEDIATE MECHANISM ?
YES
SB6
SELECT INTERMEDIATE MECHANISM
NO
NO
SB15
YES
INTERMEDIATE MECHANISM SELECTED ?
NO
SB4
SPECIFIED PAPER IN LOWER MECHANISM ?
YES
NO
C
SB22
SPECIFIED PAPER IN UPPER MECHANISM ?
YES
SELECT LOWER MECHANISM
SB7
SELECT UPPER MECHANISM
SB25
NO
SB23
SPECIFIED PAPER IN INTERMEDIATE MECHANISM ?
YES
SB26
SELECT INTERMEDIATE MECHANISM
NO
SB24
SPECIFIED PAPER IN LOWER MECHANISM ?
YES
SB27
SELECT LOWER MECHANISM
NO
SB28
SET PAPER END ERROR
RETURN

DEVICE APPLICABLE TO AN IMAGE RECORDING APPARATUS FOR FEEDING A ROLLED RECORDING MEDIUM

BACKGROUND OF THE INVENTION

The present invention relates to a device installed in an image recording apparatus for pulling out the leading edge of a rolled recording medium such as a rolled paper and then cutting the recording medium at a predetermined length as measured from the leading edge to feed the resulting sheet to a predetermined recording section of the apparatus.

A recording medium feeding device incorporated in a copier, facsimile apparatus or similar image recording apparatus may be implemented by a rolled recording medium such as a rolled paper and a cutter for cutting the recording medium at a predetermined length, as disclosed in Japanese Laid-Open Utility Model Publication (Kokai) No. 54-84482 and Japenese Laid-Open Patent Publication (Kokai). Nos. 58-113052 and 59-229370 by way of example. It has been customary to load this kind of device with a plurality of rolls and a single cutter in order to promote easy replacement of the size and property of a recording paper to be used. The cutter is located downstream of a junction where paper transport paths individually assigned to the webbings of paper which are paid out from the rolls join each other. When the paper pulled out from one of paper feed mechanisms being selected reaches a predetermined length, the cutter is driven to cut the paper to produce a recording sheet.

The prior art paper feeding device of the type described suffers from some drawbacks as follows.

(1) In order that the webbings paid out from the multiple paper rolls may be prevented from overlapping each other in the cutting section of the apparatus where the cutter is located, special members for isolating the webbings from each other have to be disposed in the junction of the transport paths or, alternatively, the paper paid out from any roll has to be retracted every time it is cut. This renders the paper feed mechanism complicated.

(2) While the cutter is in operation, the paper to be fed next cannot be paid out. Since an ordinary rotary cutter needs about 500 milliseconds of operation time per cycle, a substantial interval or waiting time needs to be provided between the cutting of a paper and the start of pay-out of the next paper. Hence, the average paper feed speed available during continuous paper feed mode operation is limited.

SUMMARY OF THE INVENTION

It is therefore an object of the present invention to provide a rolled recording medium feeding device for an image recording apparatus which is operable at a high average paper feed speed in a continuous paper feed mode.

It is another object of the present invention to provide a generally improved device applicable to an image recording apparatus for feeding a rolled recording medium.

A device installed in an image recording apparatus for feeding a rolled recording medium of the present invention comprises a plurality of recording medium feeding means each comprising pulling means for pulling the leading edge of a rolled recording medium onto a predetermined transport path by holding a part of the recording medium, driving means disposed on the transport path for driving the pulling means, and cutting means for cutting the recording medium along an axis which is substantially perpendicular to an intended direction of recording medium feed, and control means for controlling the recording medium feeding means such that the recording medium feeding means for pulling out the recording medium are switched from one to another every time an operation for feeding the recording medium occurs.

BRIEF DESCRIPTION OF THE DRAWINGS

The above and other objects, features and advantages of the present invention will become more apparent from the following detailed description taken with the accompanying drawings in which:

FIGS. 10A and 10B are flowcharts showing the outline of the operation of a main control unit of FIG. 4A.

DESCRIPTION OF THE PREFERRED EMBODIMENT

Figure 1:
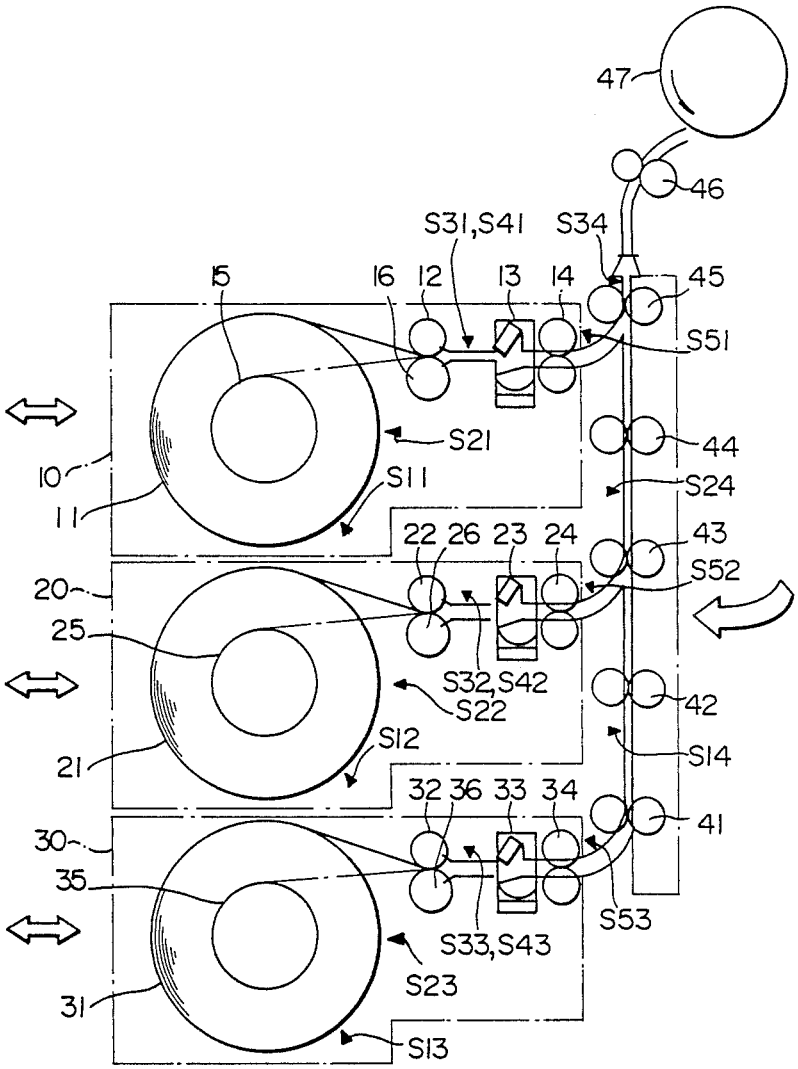
FIG. 1 is a front view showing paper feed mechanisms and their associated elements of a copier to which the present invention is applied.

Referring to FIG. 1 of the drawings, a paper feeding section of a copier to which the present invention is applied is shown. In the figure, the copier includes three paper feed mechanisms 10, 20 and 30 which are disposed one above another. The paper feed mechanism 10 is provided with a rotatable shaft 15 on which a roll of paper roll 11 is mounted, a feed roller 16 for paying out the paper from the roll 11, a pinch roller 12 facing the feed roller 16, a cutter assembly 13 for cutting the paper paid out from the roll 11, a pull-out roller 14, etc. The shaft, 15, a rotatable shaft on which the feed roller 16 is mounted and a rotatable shaft included in the cutter assembly 13 are respectively operatively connected to an electromagnetic brake BRK, an electric motor M1 and an electric motor M2 which will be described. Operatively connected to an electric motor, not shown, the pull-out roller 14 is driven in synchronism with the recording operation of the copier. Likewise, the sheet feed mechanisms 20 and 30 are respectively provided with paper rolls 21 and 31, feed rollers 26 and 36, pinch rollers 22 and 32, cutter assemblies 23 and 33, pull-out rollers 24 and 34, etc. In this particular example, each of the feed rollers 16, 26 and 36 is driven by a different electric motor, and so is each of the cutter assemblies 13, 23 and 33. A vertical transport mechanism includes a number of transport rollers 41 to 45 and is located downstream of the pull-out rollers 14, 24 and 34. Located downstream of the vertical transport mechanism is a register roller 46. The reference numeral 47 designates a photoconductive drum adapted for the recording operation.

Figure 2A:
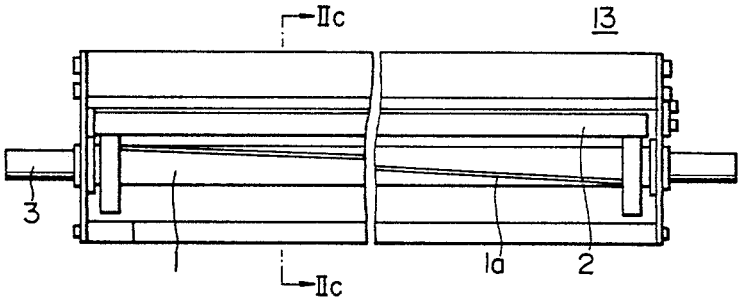
FIG. 2A is a side elevation of a cutter assembly as viewed from the left of FIG. 1.
Figure 2B:
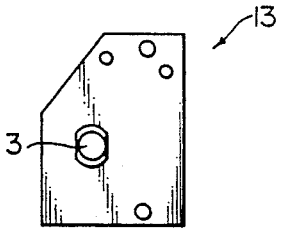
FIG. 2B is a side elevation of the cutter assembly as viewed from the left of FIG. 2A.
Figure 2C:
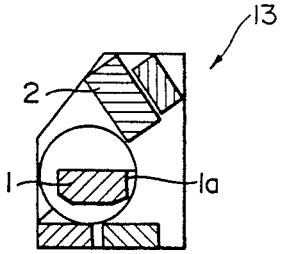
FIG. 2C is a section along line IIc—IIc of FIG. 2A.

FIGS. 2A, 2B and 2C show the cutter assembly 13 of FIG. 1 in detail. Implemented as a rotary cutter, the cutter assembly 13 includes a rotary blade 1 and a stationary blade 2. The rotary blade 1 has an edge 1*a* which extends obliquely (or spirally) relative to the axis of rotation of the blade 1. Hence, the meshing point of the rotary blade 1 and stationary blade 2, i.e., cutting point sequentially shifts from one end to the other end of the axis of rotation as the blade 1 is rotated. The paper is fully cut before the rotary blade 1 completes one rotation. A shaft 3 connected to the rotary blade 1 is operatively connected to the output shaft of the electric motor M2. The other cutters 23 and 33 are constructed in the same manner as the cutter assembly 13.

Figure 2D:
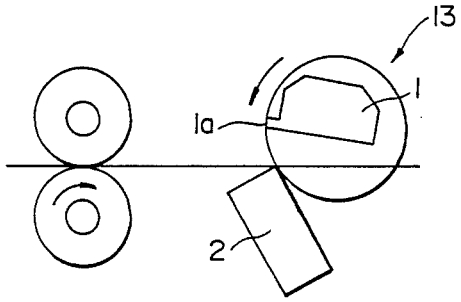
FIGS. 2D, 2E and 2F schematically show the operation of an ordinary rotary cutter.
Figure 2E:
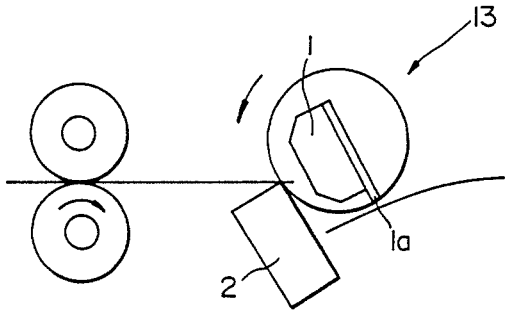
Figure 2F:
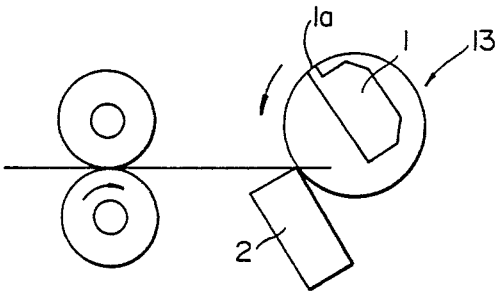

FIGS. 2D, 2E and 2F demonstrate an exemplary operation of a rotary cutter for cutting a webbing of paper. It is to be noted that the positional relationship between the rotary blade 1 and the stationary blade 2 is opposite to the relationship shown in FIG. 2C.

Figure 8A:
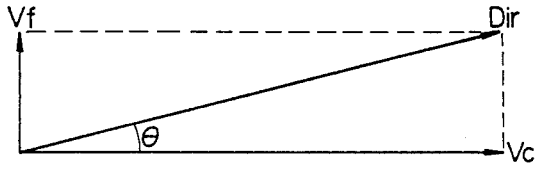
FIG. 8A is a vector diagram showing a relationship between the movement of paper paid out from a roll and the movement of a cutting point.
Figure 8B:
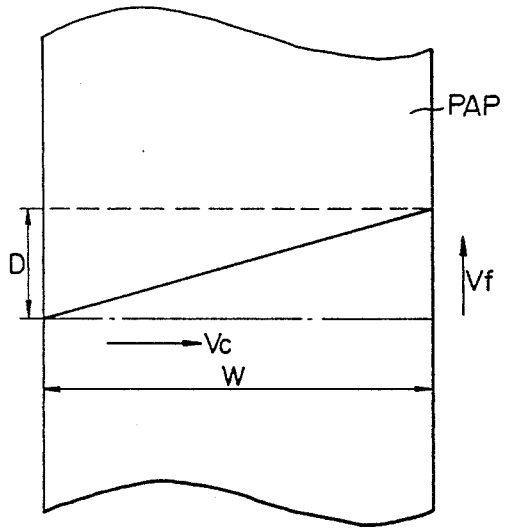
FIG. 8B is a plan view showing a cutting position where the paper is to be cut.

When the cutter assembly 13 is operated to cut the paper 11 being paid out, the cutting line extends obliquely relative to the axis of rotation of the cutter assembly 13, as shown in FIG. 8B. This is because the paper 11 is advanced in the intended direction of paper feed while the cutting point sequentially shifts from one end to the other end of the paper 11. However, interrupting the feed of the paper 11 for cutting it would prolong the period of time necessary for cutting the paper 11. The inclination of the cutting line mentioned above is dependent upon the shifting rate of the cutting point and the feeding rate of the paper 11. In the illustrative embodiment, therefore, a control is so executed as to maintain this inclination constant and the cutter assemblies 13, 23 and 33 are each fixed in a position which is inclined complementary to and in the opposite direction to the inclination of the cutting line. This arrangement allows the actual cutting line of the paper 11 to extend in a direction perpendicular to the direction of paper feed, thereby eliminating oblique cutting.

Referring again to FIG. 1, the paper feed mechanism 10 further includes two sensor units S31 and S41 interposed between the feed roller 16 and the cutter assembly 13, two sensor units S11 and S21 located to face the periphery of the roll 11, and a sensor unit S51 located downstream of the pull-out roller 14. The other paper feed mechanisms 20 and 30 are each provided with similar sensor units S32, S42 and S52 and S33, S43 and S53.

Figure 3A:
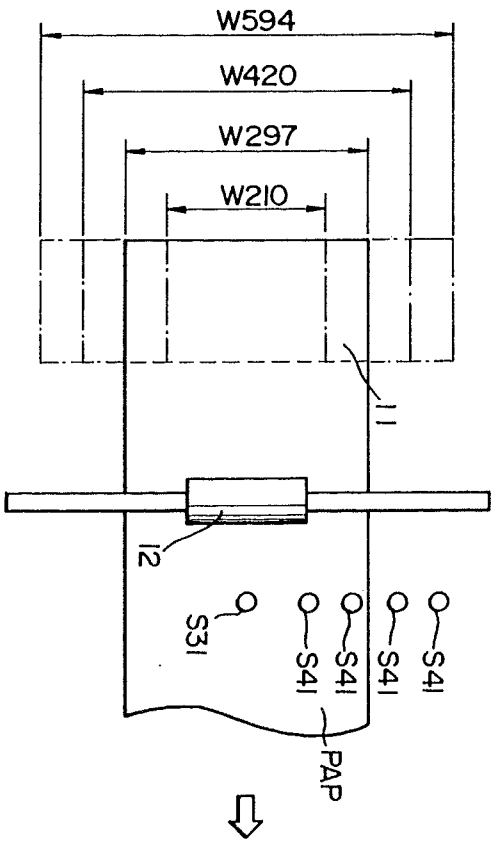
FIG. 3A is a plan view representative of a positional relationship between a paper roll and sensor units.
Figure 3B:
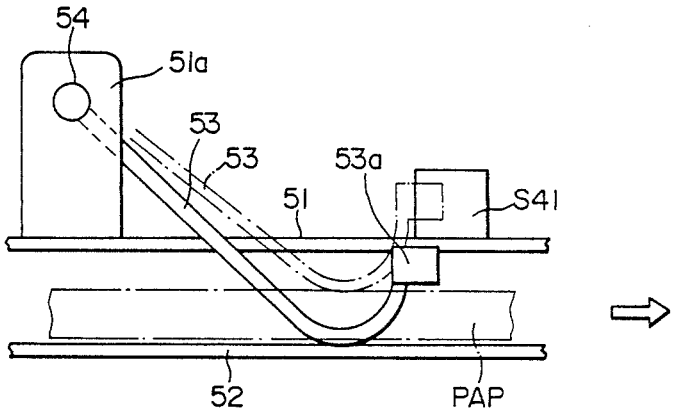
FIG. 3B is an enlarged front view schematically showing one of the sensor units and its neighborhood.

FIG. 3A is a plan view showing a positional relationship between the sensor units S31 and S41. In FIG. 3A, the sensor unit S31 is positioned at the center of a paper (labeled PAP) transport path while the sensor unit S41 is made up of four independent sensors. Implemented as a reflection type optical sensor, the sensor unit S31 determines the kind of the paper PAP in terms of reflectivity. As shown in FIG. 3B, the four sensors of the sensor unit S41 are mounted on a paper guide 51 which defines the transport path for the paper PAP which is paid out from the roll 11. A sensing arm 53 is located in the vicinity of each sensor of the sensor unit S41 and tiltably supported by a shaft 54 on the paper guide 51. The arm 53 has a light intercepting piece 53*a* at its free end. The light intercepting piece 53*a* is positioned such that it protrudes into an optical path of the sensor when the paper PAP exists on a paper guide 52 and retracts therefrom when the paper PAP does not exist on the paper guide 52.

The illustrative embodiment is designed on the assumption that the copier is operable with paper rolls having widths of 210 millimeters, 297 millimeters, 420 millimeters, and 594 millimeters. Since the paper paid out from any of such rolls is transported with its center being aligned with the center of the transport path, the four sensors of the sensor unit S41 are individually disposed at positions slightly short of 105 millimeters, 149 millimeters, 210 millimeters and 297 millimeters as measured from the centerline of the transport path. In this construction, the statuses of electrical outputs of the four sensors change on the basis of the width of a paper roll and, hence, the width of a paper roll can be determined by referencing an electrical signal outputted by the sensor unit S41.

Figure 3C:
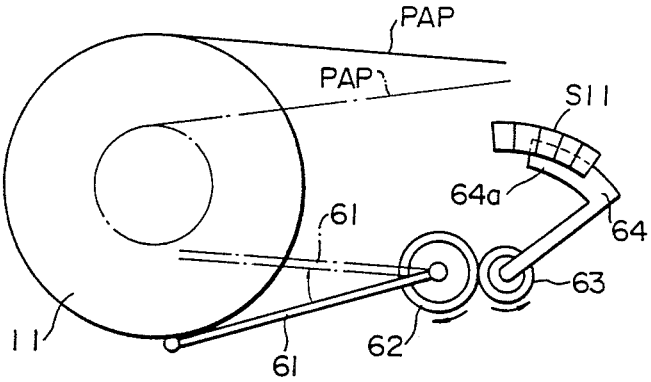
FIG. 3C is a front view schematically showing another sensor unit and its neighborhood.

FIG. 3 shows details of the sensor unit S11 which is located to face the periphery of the roll 11. In the figure, a sensing arm 61 is connected to a rotatable shaft on which a roller 62 is mounted. The arm 61 is constantly biased by a spring, not shown, such that its free end remains in pressing contact with the periphery of the roll 11. Since the diameter of the roll 11 sequentially changes with the amount of remaining paper, the arm 61 tilts on the basis of the amount of remaining paper. A roller 63 is held in contact with the roller 62 while a light intercepting plate 64 is rigidly connected to a shaft on which the roller 63 is mounted. As the arm 61 tilts in response to a change in the diameter of the roll 11, the roller 63 is rotated via the roller 62 to shift the light intercepting plate 64. The sensor unit S11 is disposed in a path along which the plate 64 is movable. The sensor unit S11 is constituted by five transmission type optical sensors which are arranged side by side in the direction of movement of the plate 64. Hence, the combination of statuses of electrical outputs of the five sensors changes with the diameter of the roll 11 so that the amount of remaining paper of the roll 11 can be determined with respect to six different levels by referencing an electrical signal outputted by the sensor unit S11.

The sensor unit S21 is also located to face the periphery of the roll 11 and implemented as a reflection type optical sensor for sensing the presence/absence of the roll 11. The surface of the shaft 15 on which the roll 11 is mounted is painted black while the roll 11 is white. Hence, the level of light incident to the sensor unit S21 noticeably varies depending upon the presence/absence of the roll 11, i.e., the presence/absence of the roll 11 can be determined on the basis of the output level of the sensor unit S21. The sensor units S51, S14, S24 and S34 are adapted to determine the presence/absence of the paper in their particular positions. The sensor units S12, S22, S32, S42 and S52 of the paper feed mechanism 20 and the sensor units S13, S23, S33, S43 and S53 are identical in construction and function with the sensor units S11, S21, S31, S41 and S51, respectively.

Figure 9:
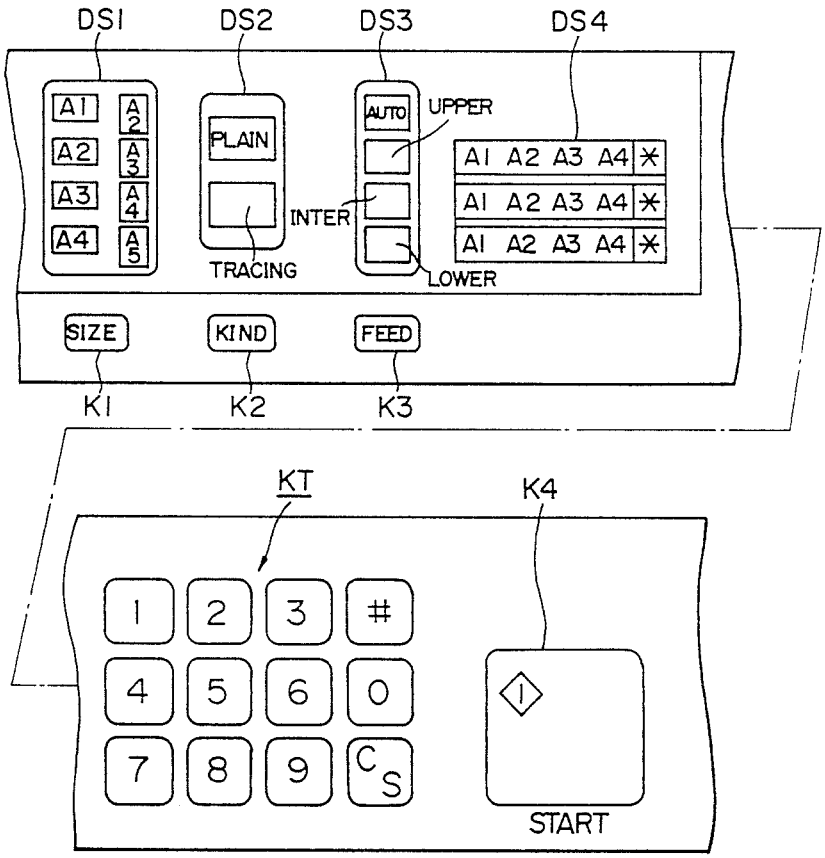
FIG. 9 is a plan view showing a part of an operation board which is included in the copier of FIG. 1.

Referring to FIG. 9, an operation board of the copier which includes the paper feeding section of FIG. 1 is shown in a fragmentary view. As shown, the operation board is provided with a number of key switches K1, K2, K3, K4 and KT and various display units DS1, DS2, DS3 and DS4.

The key switch K1 is used to enter the size of a desired paper. Specifically, every time the key K1 is pressed, various sizes or formats are sequentially selected such as A1 (vertically long), A2 (vertically long), A3 (vertically long), A4 (vertically long), A2 (horizontally long), A3 (horizontally long), A4 (horizontally long), and A5 (horizontally long). The size and orientation selected appear on the display unit DS1. The key switch K2 is adapted to select a particular kind of paper (material). Every time the key switch K2 is pressed, a plain paper and a tracing paper are selected alternately while the kind of paper selected is shown on the display unit DS2. The key switch K3 is accessible for selecting one of the upper, intermediate and lower paper feed mechanisms 10, 20 and 30. Every time the key switch K3 is pressed, the upper paper feed mechanism 10, intermediate paper feed mechanism 20, lower paper feed mechanism 30 and an automatic sheet feed mode are sequentially selected, and the display unit DS3 is associated with this key switch K3. In an initial condition (as well as after resetting) before the depression of the key switch K3, the automatic paper feed mode is selected. The display unit DS4 displays the sizes and kinds of paper rolls which are individually loaded in the paper feed mechanisms 10, 20 and 30. KT is representative of ten keys which are available for entering a desired number of copies, for example. The key switch K4 is a start key for entering a copy start command.

Figure 4A:
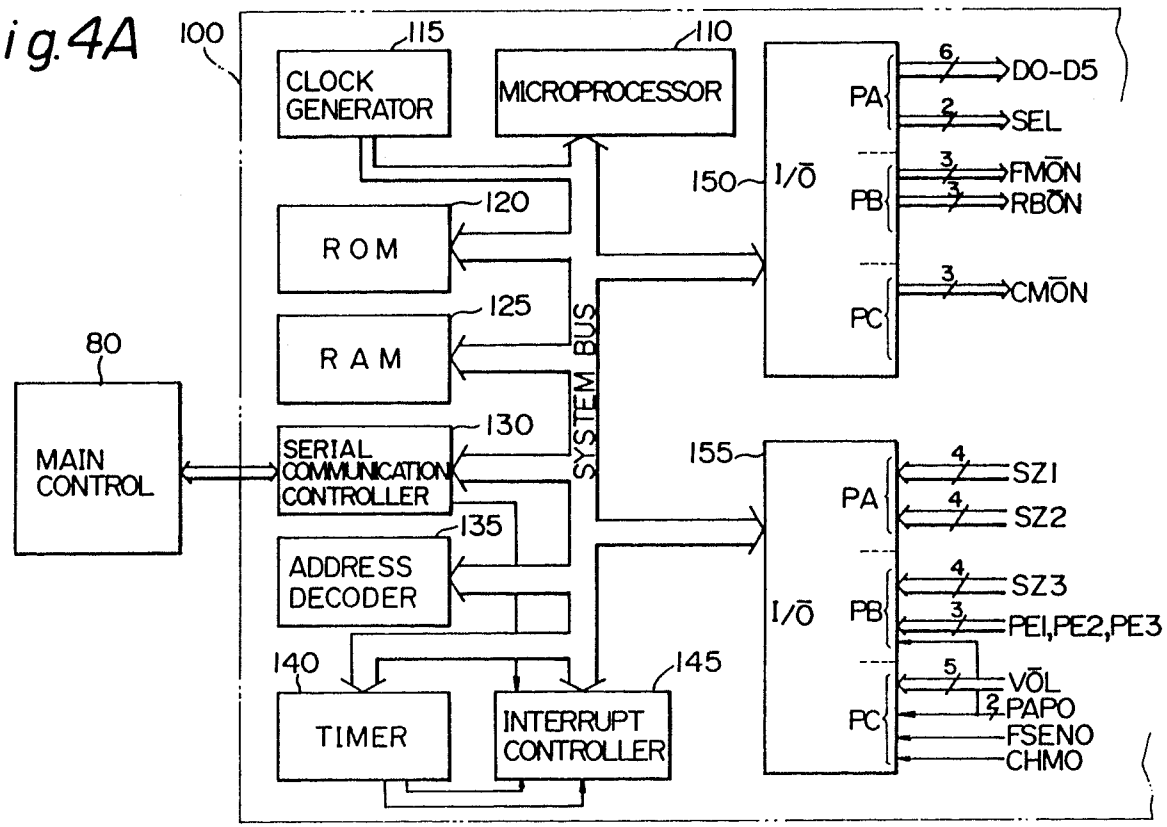
FIGS. 4A and 4B are schematic block diagrams showing, when combined, an electric circuit included in the paper feeding device.
Figure 4B:
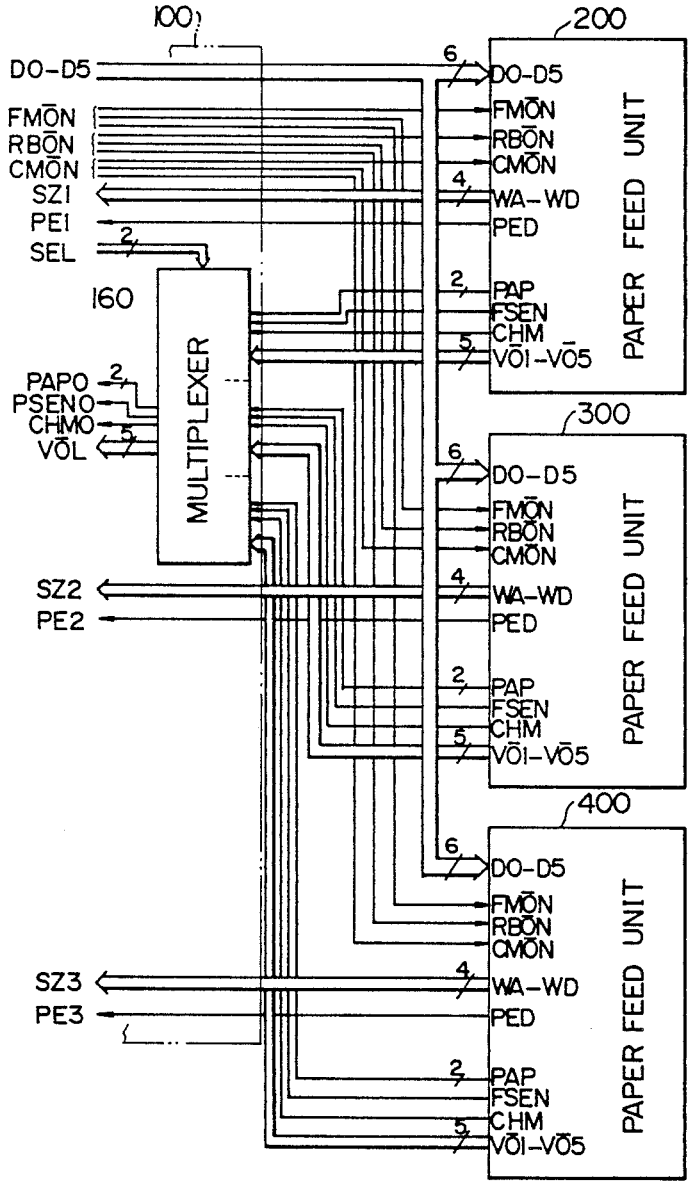

Referring to FIGS. 4A and 4B, an electric circuit associated with the paper supplying device of the copier shown in FIG. 1 is shown. In the figures, a paper feed control unit 100 is connected to three paper feed units 200, 300 and 400 which are associated with the paper feed mechanisms 10, 20 and 30, respectively. The paper feed control unit 100 includes a microprocessor 110, a clock signal generator 115, a ROM 120, a RAM 125, a serial communication controller 130, an address decoder 135, a timer 140, an interrupt controller 145, input/output (I/O) controllers 150 and 155, and a multiplexer 160. The control unit 100 is connected to a main control unit 80 of the copier to receive a paper feed start command, a paper feed mechanism select command, and data including a cutting length of paper.

The clock signal generator 115 delivers a predetermined clock to each of the microprocessor 110, serial communication controller 130, timer 140, etc. More specifically, the timer 140 counts 2.5 megahertz clock pulses from the clock signal generator 115 and in turn applies an interrupt request signal to the interrupt controller 145 at a period of 1 millisecond. The I/O controllers 150 and 155 are each provided with three groups of I/O ports PA, PB and PC each having eight ports, each port being usable for both of input and output. In the illustrative embodiment, all the ports of the I/O controller 150 are assigned to output while all the ports of the I/O controller 155 are assigned to input.

Among the ports of the I/O controller 150, six ports are commonly connected to terminals D0 to D5 of the paper feed units 200, 300 and 400, two ports are connected to a selection signal line SEL of the multiplexer 160, three ports are individually connected to terminals FM$\overline{\text{ON}}$ of the paper feed units 200, 300 and 400, three ports are individually connected to terminals RB$\overline{\text{ON}}$ of the paper feed units 200, 300 and 400, and three ports are individually connected to terminals CM$\overline{\text{ON}}$ of the paper feed units 200, 300 and 400. Among the ports of the other I/O controller 155, four ports are connected to terminals WA to WD of the paper feed unit 200, four ports are connected to terminals WA to WD of the paper feed unit 300, four ports are connected to terminals WA to WD of the paper feed unit 400, three ports are individually connected to terminals PED of the paper feed units 200, 300 and 400, two ports are connected to a signal line PAP0 of the multiplexer 160, five ports are connected to a signal line V$\overline{\text{O}}$L of the multiplexer 160, one port is connected to a signal line FSEN0 of the multiplexer 160, and one port is connected a signal line CHM0 of the multiplexer 160. Three groups of input terminals of the multiplexer 160 are connected to terminals PAP, PSEN, CHM and V$\overline{\text{O}}$1 to V$\overline{\text{O}}$5 of the paper feed units 200, 300 and 400. One of such three groups of input terminals is selected on the basis of a status of the signal line SEL so that a signal appearing on the signal line SEL appears on the output terminal. For example, when the first group of input terminals is selected, the same signals as those appearing on the output terminals PAP, FSEN, CHM and V$\overline{\text{O}}$1 to V$\overline{\text{O}}$5 of the paper feed unit 200 appear on the signal lines PAP0, FSEN0, CHM0 and V$\overline{\text{O}}$L, respectively.

Figure 4C:
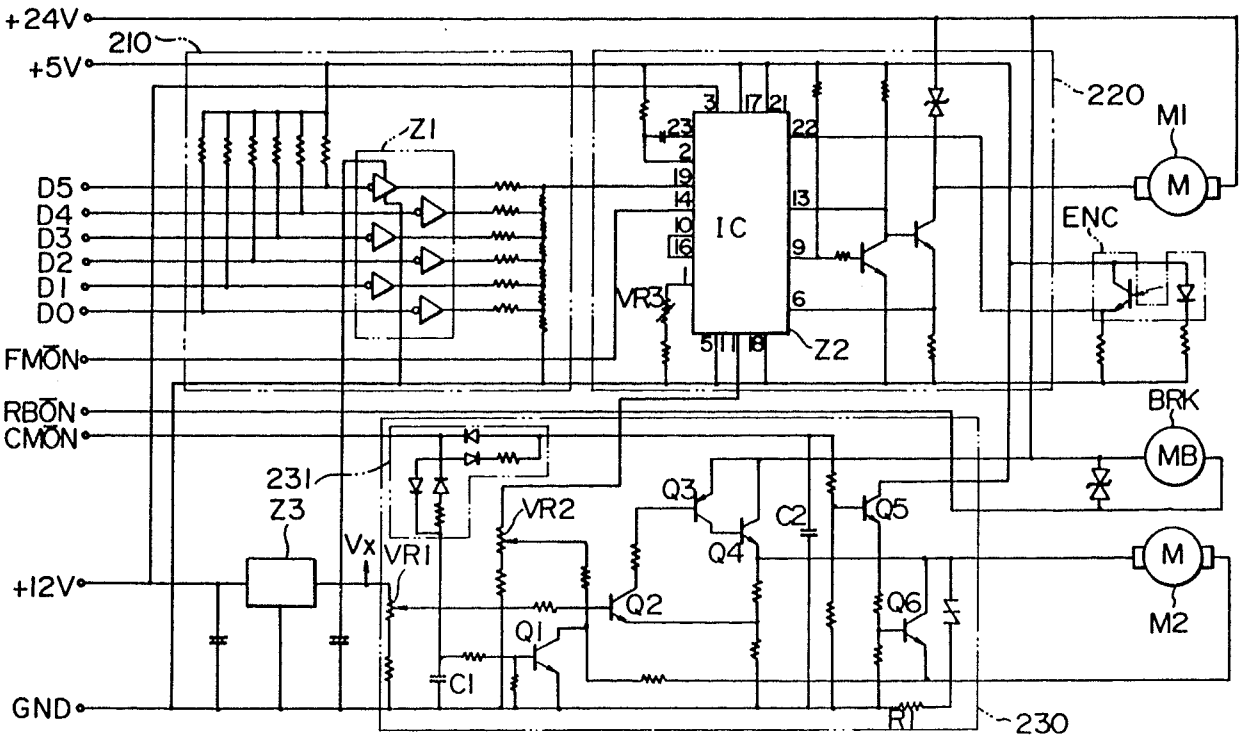
FIGS. 4C and 4D are schematic circuit diagrams showing a paper feed unit in detail.
Figure 4D:
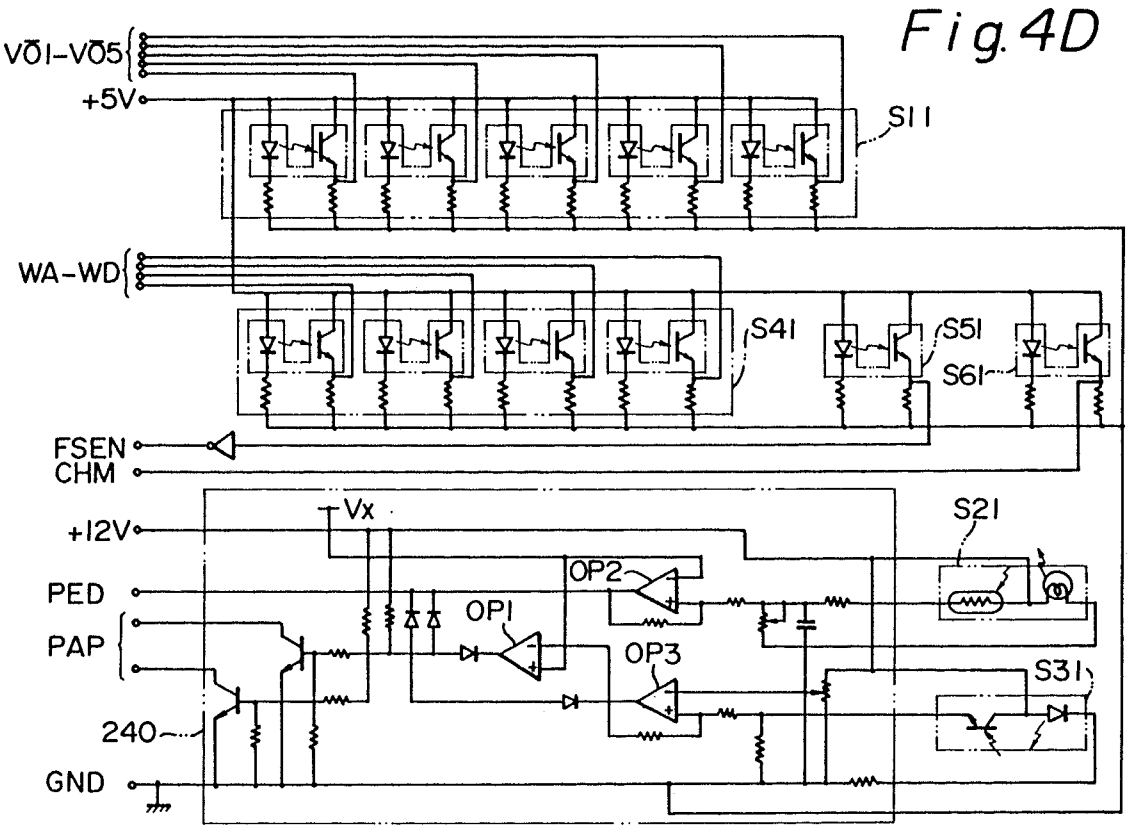

FIGS. 4C and 4D show a specific construction of the paper feed unit 200. As shown, the sheet feed unit 200 includes a digital-to-analog (DA) converting circuit 210, a servo control circuit 220, a motor driving circuit 230, and an analog comparing circuit 240. Implemented by an inverter Z1 and a number of resistors, the DA converting circuit 210 converts a digital signal appearing on input terminals D0 to D5 thereof into an analog signal. The analog signal outputted by the circuit 210 is fed as a speed command signal to the servo control circuit 220. In the illustrative embodiment, the digital signal applied to the DA converting circuit 210 has six bits and, therefore, sixty-four different speed command signals may be produced as needed.

Figure 4E:
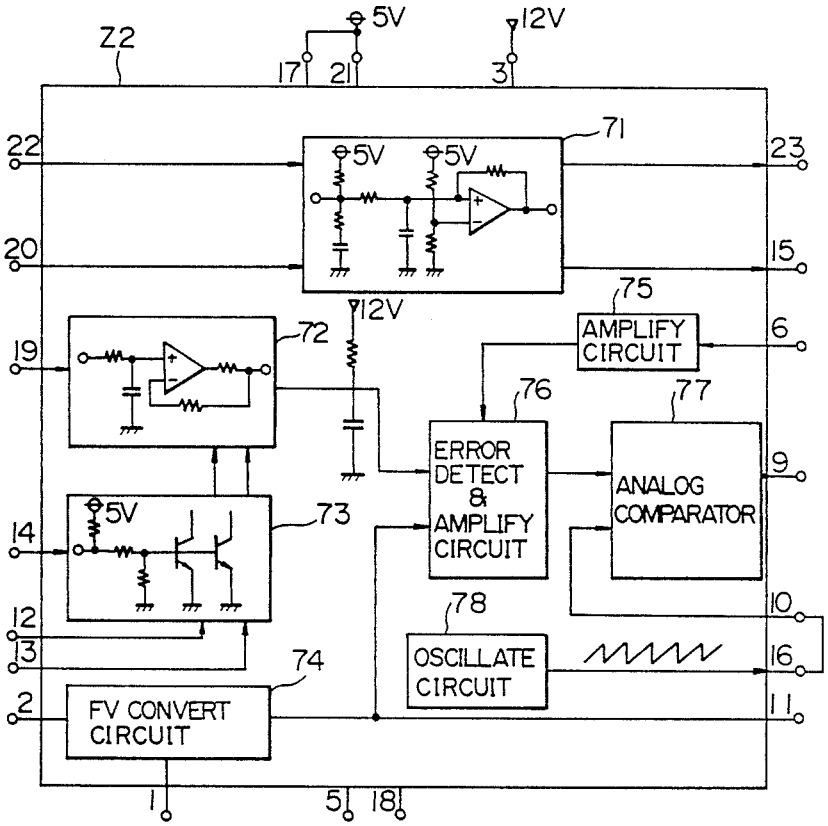
FIG. 4E is a shematic block diagram showing details of an integrated circuit included in the arrangement of FIG. 4C.

The servo control circuit 220 includes an integrated circuit (IC) Z2 and a power amplifying transistor. The IC Z2 comprises a hybrid IC which includes a major part of control elements necessary for the control of a servo motor. As shown in detail in FIG. 4E, the IC Z2 includes a waveform shaping circuit 71, a buffer 72, a level converting circuit 73, a frequency-to-voltage (FV) converting circuit 74, an amplifying circuit 75, an error detecting and amplifying circuit 76, analog comparator 77, and an oscillating circuit 78. The electric motor M1 is connected to an output terminal of the servo control circuit 220. The output shaft of the motor M1 is drivably connected to the shaft of the feed roller 16. Implemented as a DC servo motor, the motor M1 has an output shaft to which a disk of a rotary encoder is connected. The rotation of the disk is sensed by a transmission type optical sensor ENC. The sensor ENC comprises a light emitting diode and a phototransistor and produces one pulse every time the disk is rotated by a predetermined amount.

The output signal of the sensor ENC is fed back to the servo control circuit 220 to serve as a rotation signal associated with the motor M1. In the circuit 220, the rotation signal is applied to the FV converting circuit 74 via the waveform shaping circuit 71 and, therefore, a voltage or velocity feedback voltage associated with the rotation speed of the motor M1 appears on an output terminal of the FV converting circuit 74. The error detecting and amplifying circuit 76 delivers to the comparator 77 a voltage associated with a difference between a voltage which is outputted by the DA converting circuit 210 and the feedback voltage. The comparator 77 then produces a binary signal by comparing the output voltage of the circuit 76 and a voltage outputted by the oscillating circuit 78 and having a saw-toothed waveform. The binary signal is amplified by two transistors which are connected to the IC Z2 with respect to power so as to on-off control the motor M1.

When the actual rotation speed of the motor M1 is lower than a target speed (associated with a speed command signal), the output level of the error detecting and amplifying circuit 76 increases to increase the duty of the binary signal which appears on the output of the comparator 77. As a result, the level for energizing the motor M1 is increased to accelerate the motor M1. Conversely, when the actual speed of the motor M1 is higher than the target speed, the output level of the error detecting and amplifying circuit 76 decreases to reduce the duty of the binary signal and, hence, the motor energizing level is lowered to decelerate the motor M1. In any case, the the servo control circuit 220 controls the motor M1 to equalize the actual and target motor speeds. The drive of the motor M1 is on-off controlled by a signal which is applied to a pin #14 of the IC Z2, i.e., terminal $FM\overline{ON}$. It is to be noted that a semifixed resistor VR3 is connected to a pin #1 of the IC Z2 and used to adjusts the relationship between the speed command signal and the motor speed.

The motor M2 is connected to an output terminal of the motor driving circuit 230. The motor M2 is implemented as a DC servo motor, but it is not provided with a rotary encoder. The motor driver 230 is provided with a servo control circuit which is simpler than the IC Z2. Specifically, the motor drive 230 is provided with a circuit for sensing a current flowing through the motor M2 by means of a resistor R1, feeding back a signal associated with the sensed current to th base terminal of a transistor Q2 to adjust a current to flow through the motor M2, and thereby stabilizing the rotation of the motor M2. The motor M2 is on-off controlled by a signal which is applied to the terminal $CM\overline{ON}$. More specifically, when the terminal CMON has a low level, a transistor Q1 is turned off, the transistor Q2 is turned on, a transistor Q3 is turned on, and a transistor Q4 is turned on. In this condition, a current flows from one end (+24 volts) to the other end (ground or GND) of a power supply line to energize the motor M2.

The level for energizing the motor M2 changes with the level of current which flows through the base terminal of the transistor Q2. In the illustrative embodiment, a current associated with the output voltages of variable resistors VR1 and VR2 and the terminal voltage of the resistor R1 is caused to flow through the base terminal of the transistor Q1. One end of the variable resistor VR1 is connected to ground via a resistor while a fixed voltage Vx (+5 volts) produced by a 3-terminal regulator is applied to the other end of the variable resistor VR1. The variable resistor VR2 is connected at one end to ground via a resistor and at the other end to a pin #11 of the IC Z2. Appearing on the pin #11 of the IC Z2 is a voltage which is associated with the rotation speed of the motor M1. Hence, the current flowing through the base terminal of the transistor Q2 is adjustable as desired by operating the variable resistors VR1 and VR2. Further, this current is variable with the rotation speed of the motor M1.

In this particular embodiment, a paper is cut while being sequentially paid out from a roll and, hence, the cutting line is inclined relative to the axis of a cutter, as previously stated. However, since the cutter assembly 13 is inclined complementary to and in the opposite direction to the inclination of the cutting line, the cutting line becomes perpendicular to the direction of paper feed when the inclination of the cutter assembly 13 is the same as the inclination of the cutting line relative to the cutter axis. A problem arises here is that the diameter of the feed roller 16 suffers from machining errors and, therefore, the actual paper transport rate of the feed roller 16 differs from one apparatus to another even when the motor M1 is driven at the same speed. When the cutting speed of the cutter is constant, a change in paper transport speed results in a change in the inclination of the cutting line relative to the axis of the cutter assembly. Further, the inclination of the cutter assembly is apt to differ from on apparatus to another due to machining errors. In this particular embodiment, the relationship between the level of the speed command signal and the rotation speed of the motor M1 is adjustable by using the variable resistor VR3 so as to compensate for the irregularity in the diameter of the feed roller 16. Further, the speed of the motor M2 and therefore the paper cutting speed is adjustable by using the variable resistors VR1 and VR2. Since both of a paper feed speed Vf and a cutting speed Vc are adjustable as mentioned above, the angle of inclination of the cutting line relative to the axis of the cutter assembly can be adjusted as desired. This is successful in compensating for the scattering among products with respect to dimensions and position and thereby equalizing the inclination of the cutting line relative to the axis of the cutter assembly and the inclination of the cutter assembly itself.

It is sometimes desired to change the paper feed speed in conformity to a change in the speed of a recording apparatus or a change in the specification of a paper feeding device itself. Assuming that the paper cutting speed is constant, any change in paper feed speed, i.e., in the rotation speed of the feed roller 16 causes the inclination of the actual cutting line relative to the axis of the cutter assembly to change. In the illustrative embodiment, however, a current associated with the rotation speed of the motor M1 flows through the base terminal of the transistor Q2 so that the drive speed of the motor M2 is changed on the basis of that current. More specifically, the drive speed of the motor M2 is controlled to remain proportional to the drive speed of the motor M1. So long as such two motor drive speeds are proportional to each other, the inclination of the cutting line relative to the axis of the cutter assembly is not changed even when the drive speed of the motor M1 is changed. That is, even when the setting of the speed command signal associated with the motor M1 is changed, the inclination of the cutting line relative to the cutter assembly and the inclination of the cutter assembly itself are not deviated from each other, preventing the paper from being cut obliquely. This is also true when the rotation speed of the motor M1 is affected by a change in load, for example. The variable resistor VR2 is operable to change the ratio between a change in the rotation speed of the motor M1 and a change in the rotation speed of the motor M2. The variable resistor VR2 is set during adjustment such that the drive speed of the motor M2 is proportional to the drive speed of the motor M1.

In the illustrative embodiment, two variable resistors VR1 and VR2 are used to adjust the speed of the cutter drive motor M2. Alternatively, when the speed signal voltage appearing on the pin #11 of the IC Z2 does not include an offset voltage, the variable resistor VR1 may be omitted. .

On the other hand, when the terminal CM$\overline{O}$N has a high level, the transistor Q1 is turned on, the ransistor Q2 is turned off, the transistor Q3 is turned off, and the transistor Q4 is turned off, interrupting the energization of the motor M2. In this case, both of the transistors Q5 and Q6 are turned on, the voltage developed across the terminals of the motor M2 is absorbed by the transistor Q6. In this sense, the transistors Q5 and Q6 serve as a braking circuit which sharply brakes the motor M2 upon the stop of drive of the motor M2. However, the on-off control timing associated with the motor M2 and that associated with the braking circuit are not coincident, as follows. When the terminal CM$\overline{O}$N has a high level, the motor M2 is stopped and the braking circuit (Q5, Q6) is in an ON state. As the terminal CM$\overline{O}$N has a low level, the charge stored in a capacitor C2 is immediately discharged via a diode of a signal processing circuit 231 with the result that the braking circuit is immediately turned into an OFF state. However, the charge stored in a capacitor C2 is discharged by way of a series connection a diode and a resistor of the signal processing circuit 231, taking a substantial period of time. Hence, when the terminal CM$\overline{O}$N becomes low level, the transistor Q1 is turned off and therefore the motor M2 is turned on upon the lapse of a predetermined period of time after the braking circuit has been turned off.

When the terminal CM$\overline{O}$N is turned into a high level, the charge stored in the capacitor C1 is immediately discharged via the diode of the signal processing circuit 231 and, therefore, the motor M2 is immediately deenergized. However, the charge stored in the capacitor C2 is discharged by way of the series connection of a diode and a resistor of the signal processing circuit 231, taking a substantial period of time. Hence, the transistors Q5 and Q6 are turned on to activate the braking circuit associated with the motor M2 when a predetermined period of time elapses after the stop of the motor M2. The electromagnetic brake BRK is connected to the shaft 15 on which the paper roll 11 is mounted for the purpose of braking the rotation of the paper roll 11. A driver is connected between the terminal of the brake BRK and the control terminal RBON, although not shown in the figure.

As shown in FIG. 4D, the sensor unit S11 is made up of five transmission type optical sensors each comprising a light emitting diode and a phototransistor. The output terminals of the five sensors are individually connected to the terminals V$\overline{O}$1 to V$\overline{O}$5. The sensor unit S41 is constituted by four transmission type optical sensors each comprising a light emitting diode an a phototransistor, the output terminals of the sensors being individually connected to the terminals WA to WD. The sensor units S51 and S61 each comprises a single transmission type optical sensor and connected at their output terminals to the terminals FSEN and CHM. The sensor unit S61 is adapted to sense the home position of the rotary blade 1 of the cutter assembly 13. The sensor units S21 and S31 are each implemented as a reflection type optical sensor. The sensor unit S21 comprises a bulb and a cadmium sulfide (CdS) cell while the sensor unit S31 comprises a light emitting diode and a phototransistor. The output terminals of the sensor units S21 and S31 are commonly connected to the input terminal of an analog comparing circuit 240.

In the analog comparing circuit 240, a voltage associated with the resistance of the CdS cell of the sensor unit S21 is generated and compared with a predetermined voltage by an operational amplifier (OP AMP) OP2. A binary signal representative of the result of comparison appears on the terminal PED, and a status of this signal is associated with the presence/absence of a paper roll. The current flowing through the phototransistor of the sensor unit S31 is converted into a voltage and then compared with a predetermined voltage by an OP AMP OP3. A binary signal representative of the result of comparison is fed to one of the two terminals PAP via a transistor. The binary signal outputted by the OP AMP OP3 is inverted by an OP AMP OP1 and then fed to the other terminal PAP via a transistor. Therefore, when one of the two terminals PAP has a low level, the other has a high level. The levels of these terminals PAP are variable depending upon the kind of a paper roll which the sensor unit S31 senses. More specifically, the levels at the terminals PAP are set in binary levels depending upon whether the paper roll mounted is a plain paper or a tracing paper.

Figure 5A:
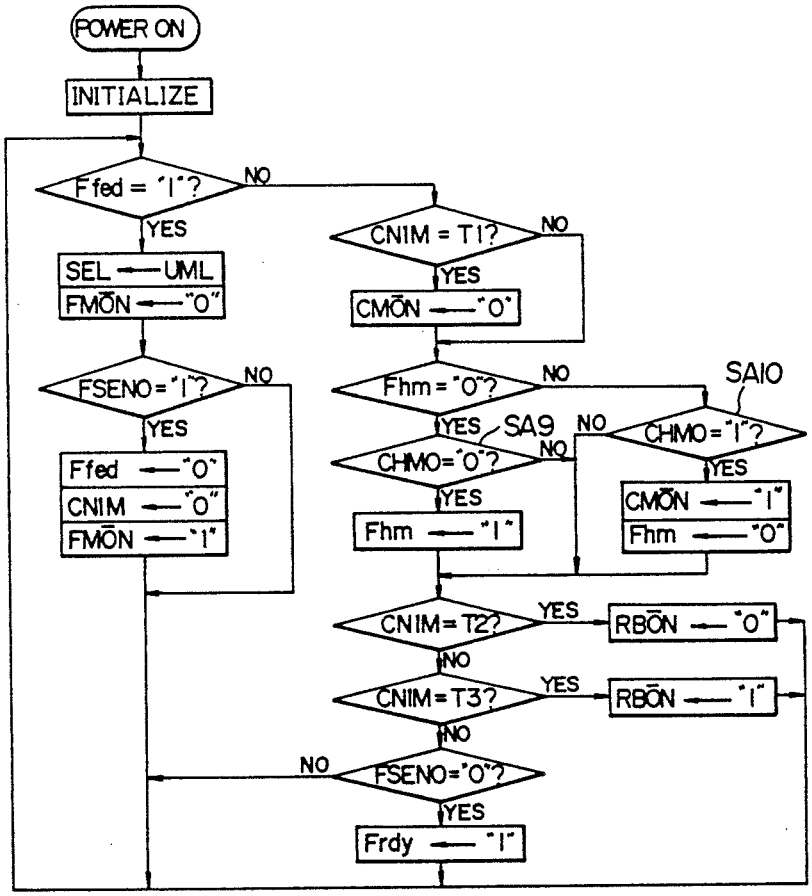
FIGS. 5A, 5B and 5C are flowcharts outlining the operation of a miroprocessor which is included in the arrangement of FIG. 4A.
Figure 5B:
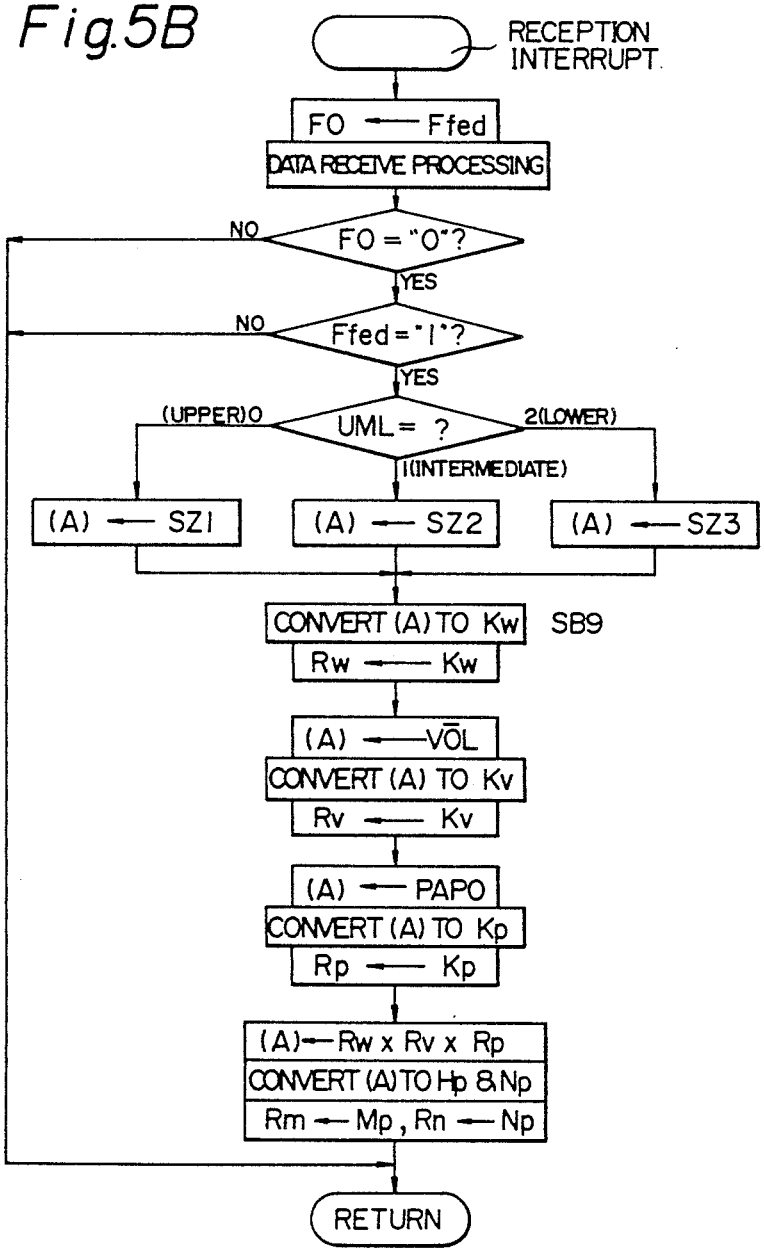
Figure 5C:
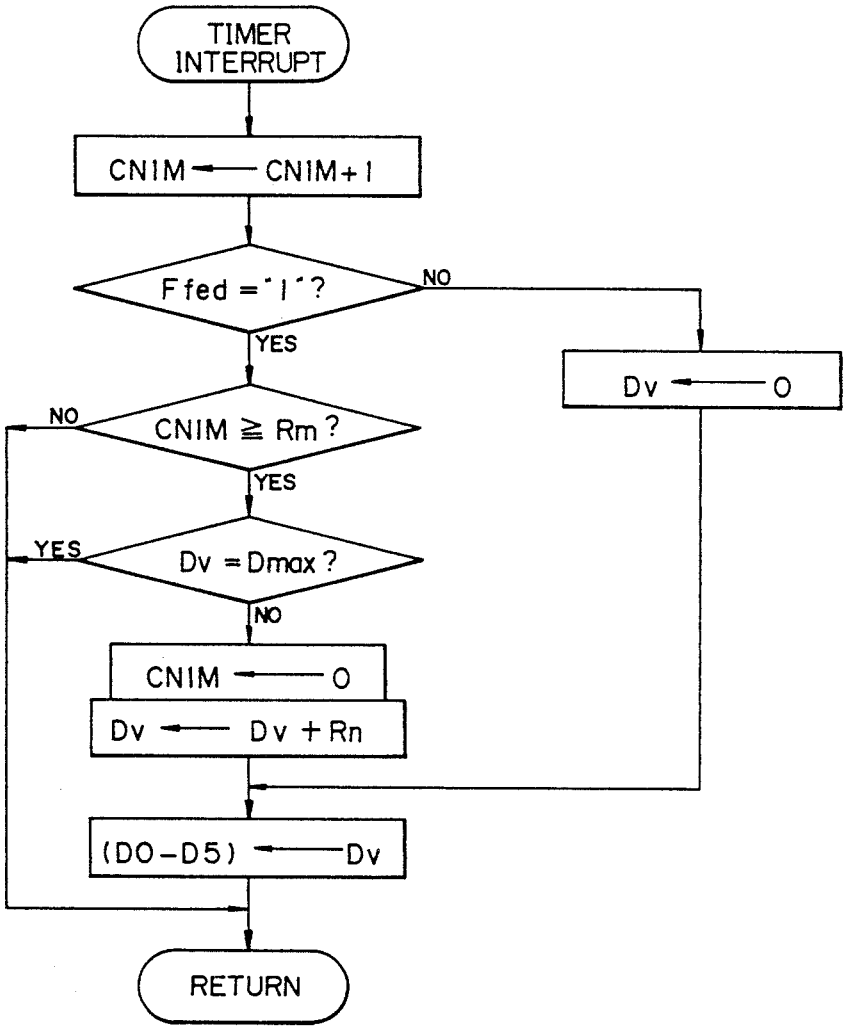

Referring to FIGS. 5A, 5B and 5C, a specific operation of the microprocessor 110 of FIG. 4A is shown in flowcharts. Specifically, FIGS. 5A, 5B and 5C demonstrate a main routine, a reception interrupt routine, and a timer interrupt routine, respectively. The reception interrupt routine is executed when the serial communication controller 130 delivers an interrupt request to the microprocessor 110 in response to data which are fed thereto from the main control unit 80. The timer interrupt routine is executed when the timer 140 delivers an interrupt request to the microprocessor 110. In the illustrative embodiment, the timer 140 periodically produces an interrupt request every 1 milliseconds.

As shown in FIG. 5A, when a power switch of the copier is turned on, the entire circuitry is initialized. Specifically, the memory 125 is cleared, the various control units 130, 140, 145, 150, 155 and 160 are restored to their predetermined statuses, and the statuses of the output ports are initialized. By such initialization, the serial communication controller 130 is prepared for communications with the main control unit, the timer 140 is conditioned to generate a signal every 1 millisecond, and the interrupt controller 145 is conditioned to control the interruption to the microprocessor 110 in response to interrupt requests from the serial communication controller 130 and timer 140. Then, a flag Ffed indicative of whether paper feed is under way is checked. The flag Ffed is set or made a (logical) ONE by data which is fed from the main control unit 80, which is connected to the serial communication controller 130 serial signal line, and becomes a (logical) ZERO when the sensor S51 (or S52 or S53) located downstream of the pull-out roller senses a paper roll.

While a sheet feed command from the main control unit 80 is absent, the flag Ffed is a ZERO and the program awaits until it becomes a ONE. As the flag Ffed becomes a ONE, the content of a register UML is fed to the signal line SEL to turn the terminal FMON to a ZERO (low level). The content of the register UML is set by data which is fed from the main control unit 80 and is indicative of one of the paper feed mechanisms 10, 20 and 30 which is selected. Hence, signals on the terminals PAP, FSEN, CHM and VOL1 to $\overline{VO5}$ associated with the paper feed unit selected by the main control unit 80 appear on the signal lines PAP0, FSEN0, CHM0, and $\overline{VOL}$, respectively. When therminal FMON is turned into a ZERO, the motor M1 associated with the feed roller 16, 26 or 36 begins to rotate. Initially, however, the speed command signal has a zero speed status.

In the reception interrupt routine shown in FIG. 5B, the content of the flag Ffed is transferred to a flag FO and, then, data reception processing is executed. In this processing, data stored in a receive register of the serial communication controller 130 is fetched and discriminated. Based on the result of discrimination, the flag Ffed and the various registers (including UML and a cutting length register) are individually loaded with data. Further, various kinds of data associated with the paper feeding device are transmitted to the main control unit 80. Immediately after a paper feed command has appeared, the flag FO is a ZERO and the flag Ffed is a ONE. At this instant, the content of the register UML is checked. If the content of the register UML is "0", "1"and "2", internal registers (A) are individually loaded with the contents of signal lines SZ1, SZ2 and SZ3. More specifically, the registers (A) are loaded with data which are associated with the widths of paper rolls mounted in the paper feed mechanisms which may be selectively operated.

In the illustrative embodiment, when the feed roller 16, 26 or 36 begins to rotate, its speed is caused to increase stepwise in order to prevent the feed roller from slipping on a paper roll. Since the force necessary for changing the speed at which a paper roll is pulled is proportional to the mass of the roll, changing the degree of acceleration in matching relation to the mass of a roll is successful in reducing the time necessary for raising the driving speed within a range which does not cause slippage. The mass of a roll is dependent upon the width, diameter and material of the roll. In this embodiment, therefore, parameters Kw, Kv and Kp representative of relationships between the width, diameter (remaining amount) and material (kind) of a roll and the mass of a roll are individually stored in the ROM 120 in the form of tables.

In a step SB9 shown in FIG. 5B, the table with parameter Kw is accessed on the basis of roll width data lodged in the register (A) so as to load the register (A) with Kw which is associated with the content of the register (A). The content of the register (A) is stored in a register Rw. Next, the content of the signal line VOL is loaded in the register (A) and, then, the table with parameter Kv is referenced to load the register (A) with Kv which is associated with the content of (A). The content of (A) is loaded in a register Rv. Further, the content of the signal line PAP0 is loaded in the register (A) and, then, the table with parameter Kp is referenced to load the register (A) with Kp which is associated with the content of (A). The content of (A) is stored in a register Rp. The contents of these registers Rw, Rv and Rp are multiplied and the resulting product is lodged in the register (A). By referencing a table in which a relationship between the mass and acceleration parameters Mp and Np is listed, parameters Mp and Np associated with the content of the register (A) are obtained. These parameters Mp and Np are stored in registers Rm and Rn, respectively.

Figure 7:
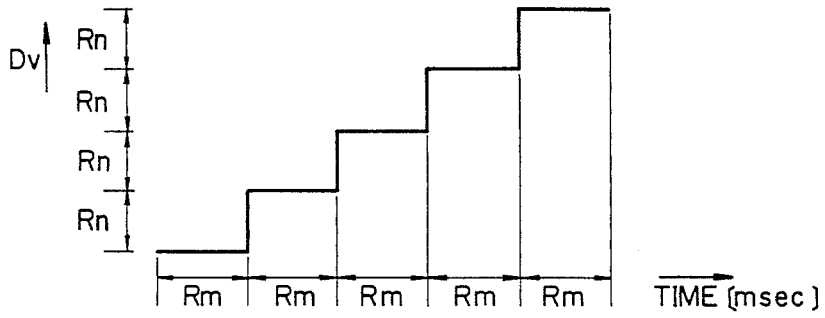
FIG. 7 is a timing chart demonstrating changes in velocity command data which occur during acceleration.

Referring to FIG. 7, there is shown the variation of speed command data Dv which is associated with the drive speed of the feed roller. As shown, the speed command data DV is added up by the content of the register Rn and updated, at a period which is associated with the content of the register Rm. More specifically, the acceleration characteristic of the feed roller and therefore the interval between the start of drive and the rotation at a steady speed, i.e., buildup time is determined by the contents of the registers Rm and Rn. In this embodiment, the buildup time is selected to be 500 milliseconds when the roll width is 594 millimeters, the roll diameter is level 5 (largest), and the paper is a tracing paper. The buildup time is selected to be 117 milliseconds when the roll width is 420 millimeters, the roll diameter is level 2, and the paper is a plain paper. Such a buildup time is proportional to a value produced by $Rw \times Rv \times Rp$. By adjusting the acceleration characteristic based on the mass of a paper roll as mentioned, it is possible to maintain the force acting between the feed roller and the paper roll substantially constant. If such a force is smaller than a magnitude which causes slippage, no slippage will occur despite any change in the width, remaining amount and/or kind of the paper roll. When this force is selected to be slightly smaller than the magnitude which causes slippage, the buildup time can be minimized within the range which does not entail slippage so as to reduce the paper feeding time.

Referring to FIG. 5C, the timer interrupt routine begins with incrementing a counter CN1M for counting time by 1. Then, the flag Ffed is checked and, if it is a ONE indicative of the fact that sheet feed is under way, the content of the counter CN1M is compared with that of the register Rm. If the counter CN1M is greater than the register Rm, the speed command data Dv is checked to see its value. If the the data Dv is short of a value Dmax representative of a steady speed, the counter CN1M is reset to "0" and the content of the register Rn is added to the data Dv to thereby update the data Dv. The resulting data Dv is fed to the signal lines D0 to D5. More specifically, since the timer interrupt routine is repeated every 1 millisecond, the increment (content of Rn) is added to the speed command data at a period which is Rm times longer than than 1 millisecond when the flag Ffed becomes a ONE. In this manner, the speed command data is updated stepwise until the result of updating reaches Dmax as shown in FIG. 7. As soon as the flag Ffed becomes a ZERO, the data Dv is cleared to become "0".

Figure 6:
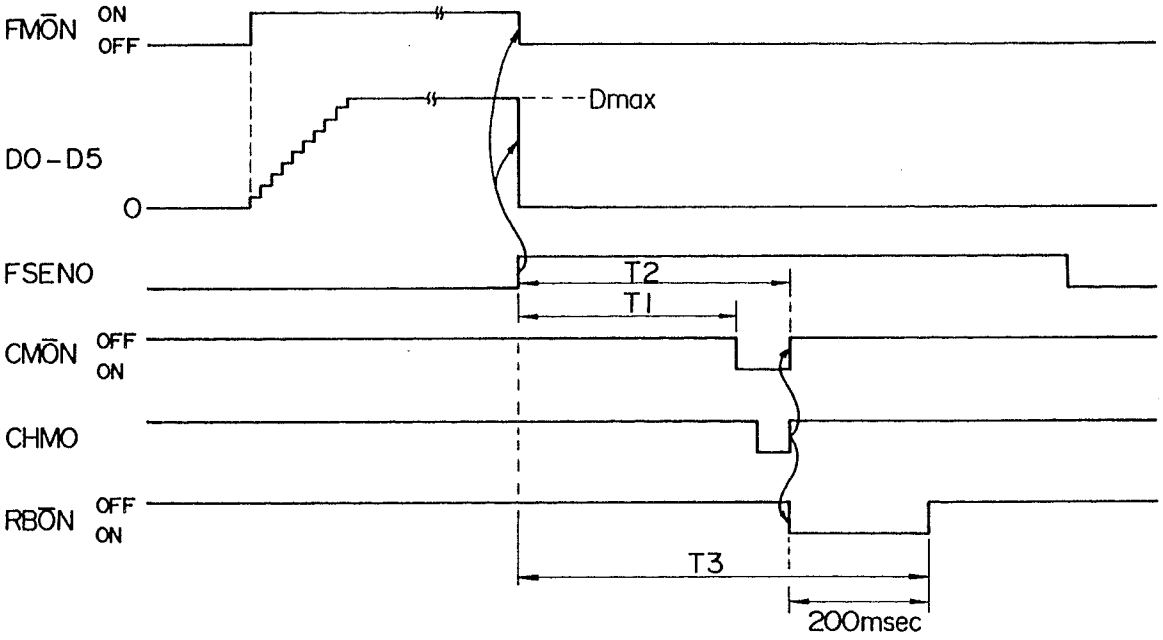
FIG. 6 is a timing chart showing examples of signals which appear in various parts of FIG. 4A.

The main routine shown in FIG. 5A will be further described with reference to the timing chart of FIG. 6. When the flag Ffed becomes a ONE, a signal $\overline{FMON}$ for commanding the drive of of the feed roller becomes ON (ZERO) so that the level of speed command data appearing on the signal lines D0 to D5 is sequentially increased stepwise, i.e., the drive speed is increased stepwise. When the speed command data reaches Dmax, it is not updated any further and the acceleration drive mode is replaced with a steady drive mode. At the instant when the sensor unit S51, S52 or S53 located downstream of the feed roller senses the paper, the sinal line FSENO becomes a ONE (high level). Then, the microprocessor resets the flag Ffed to a ZERO, clears the counter CN1M to "0", and makes the feed roller drive signal FM$\overline{ON}$ a ZERO (OFF).

As the flag Ffed becomes a ZERO, the speed command data is turned into "0" by the timer interrupt routine, as shown in FIG. 4C. In the main routine, the following procedure is executed when the flag Ffed becomes a ZERO. Specifically, the content of the counter CN1M is compared with a time T1. Since the coutner CN1M has been cleared when the signal PSENO has become a ZERO, i.e., when the sensor unit S51, S52 or S53 has sensed the leading edge of the paper, the counter CN1M is counting time from that instant. The predetermined time T1 is a duration produced by subtracting from a preselected length of paper a period of time which is associated with the distance between the cutting axis of the cutter assembly 13 and the sensing position of the sensor unit S51. Hence, when the cutter assembly 13 is actuated at the instant when the counter CN1M reachs T1, the paper paid out from the roll will be cut at the predetermined length. The length of paper is specified by the main control unit 80 and may be specified in any of three different modes as with a prior art roll paper feeding device: a first mode in which the size of an original document is sensed and a paper is cut at a length which is associated with the document size (synchronous cutting mode), a second mode in which a paper is cut at a length which is associated with a particular regular size which is selected by an operator out of a plurality of regular sizes, and a third mode in which a paper is cut at a length which is numerically selected by an operator through ten keys, for example.

When the counter CN1M reaches T1, a cutter drive signal CM$\overline{ON}$ is made a ZERO (ON) to thereby start driving the motor M2. Immediately after the drive of the motor M2, the flag Fhm is a ZERO. In this instance, the program is transferred to a step SA9 to see the status of the signal line CHM0. When the signal line CHM0 becomes a ZERO, the flag Fhm is set to a ONE. Then, the program advances to a step SA10 to see the status of the signal line CHM0. If the line CHM0 is a ONE, the cutter drive signal CM$\overline{ON}$ is turned into a ONE (OFF) and the flag Fhm is reset to a ZERO. More specifically, after the cutter drive signal CM$\overline{ON}$ has become a ZERO, it is restored to a ONE when the output signal CHM0 of the home position sensor associated with the cutter assembly 13 becomes a ONE after the change from a ONE to a ZERO.

When the counter CH1M reaches T2, a roll brake ON signal RB$\overline{ON}$ is made a ZERO (ON) to energize the electromagnetic brake BRK with the result that the rotation of the roll is braked. The time T2 is so selected as to coincide with a time at which 80 milliseconds expire after the start of drive of the cutter motor M2 (i.e. T2=T1+80 milliseconds). As the counter CN1M reaches T3, the roll brake ON signal RB$\overline{ON}$ is set to a ONE (OFF). The time T3 is so selected as to coincide with a time at which 200 milliseconds expire after the change of the brake ON signal to a ONE (i.e. T3=T2+200 milliseconds). When the sensor unit S51 senses the trailing edge of the cut sheet, i.e., when the signal line FSEN0 becomes a ZERO, a READY flag Frdy is set to a ONE. Flag Frdy data is transmitted to the main control unit 80.

In the illustrative embodiment, the feed roller drive motor M1 is deenergized as soon as the sensor unit S51 senses the leading edge of the paper, as stated earlier. Hence, in the case where the paper is cut at a position relatively remote from the leading edge of the paper, the paper is cut while being driven by the pull-out roller 14. Since the drive system for the pull-out roller 14 is dependent of the drive system for the feed roller 16, the inclination of the actual paper cutting axis relative to the cutting axis of the cutter assembly 13 in the above condition is determined by the drive speed of the pull-out roller 14 and the cutting speed of the assembly 13. However, even when the feed roller is not driven and if the paper has not been cut and is moving, the motor M1 is rotated at the same speed as the paper. Therefore, the drive speed of the paper is sensed by the rotary encoder ENC and then converted into a speed feedback signal by the FV converter circuit 74. Based on the speed feedback signal, the speed of the cutter motor M2 is automatically adjusted. In this manner, even when the drive of the feed roller is interrupted, the cutter motor M2 is automatically controlled such that the inclination of the paper cutting axis relative to the cutting axis of the cutter assembly 13 remains equal to the inclination particular to the cutter assembly 13.

Referring to FIG. 10A, the copier control performed by the main control unit 80 of FIG. 4A is outlined. As shown, when the power switch of the copier is turned on, a step SA1 for CPU initialization is executed. In this step, the main control unit 80 initializes itself by clearing a RAM, not shown, initializing various modes, and resetting output ports. The step SA1 is followed by a step SA2, i.e., initial set processing for initializing the conditions (operation modes) of various control boards and the like which are connected to the main control unit 80. Also, a mode and a value of a timer, not shown, are set. In a step SA3, wait mode processing is performed. At this instant, the copier remains in a standby condition with its operation being inhibited. More specifically, the wait mode processing begins with reading the statuses of signals which are fed to various input ports of the main control unit 80 and then storing the results in the RAM. Subsequently, the main control unit 80 delivers a group of output control data which are stored in the RAM beforehand to output ports which are individually assigned to those data, thereby controlling various units which are connected to the output ports. Further, the main control unit 80 checks the statuses of the various input ports which have been read and stored in the RAM so as to find out unusual conditions. If any unusual condition is found, the program is transferred to predetermined failure processing. If no failure is found, the main control unit 80 determines the statuses of the other input ports and, for example, processes data which are entered on the operation board of FIG. 9 while reading display data out of the RAM at predetermined timings to display them on the display units of the operation board.

The above-stated wait mode processing is repeated until a READY state is reached or until the print start key K4 is turned on (step SA4). The READY state will not be set up when the fixing temperature does not lie in a predetermined range and/or when any trouble is detected. When the print start key K4 is pressed under the READY state (step SA5), precopying mode processing shown in a step SA6 is executed to start driving the main motor, to apply precopying cleaning to the photoconductive drum, to perform sheet feed processing, etc. In the next step SA14, the main control unit 80 determines whether an automatic paper feed mechanism selection mode has been set up. For example, if the paper feed key K3 is not depressed, the program advances to a step SA15 because an automatic paper feed mechanism selection mode has been set up. However, if the key K3 is pressed to select any of the upper, intermediate and lower paper feed mechanisms 10, 20 and 30, the program advances to a step SA16. In the step SA16, the paper feed mechanism 10, 20 or 30 specified through the key K3 is selected. The automatic paper feed selection subroutine shown in a step SA15 will be described later.

Subsequently, a step SA7 is executed for causing an actual copying process to occur. The copy mode processing of this step SA7 includes copying process control, paper transport control, failure check control, etc. In the copying process control, the various process elements are each on-off controlled at a predetermined timing which is synchronous to pulses which a timing pulse generator produces in association with the rotation of the main motor. When a plurality of copies are to be produced continuously, the copying mode processing of the step SA7 is repeated. When the copying mode processing of the step SA7 is completed for the last copy, the content of a copy counter Ccopy agrees with that of a set number register Nset so that the program is transferred to postcopying mode processing of a step SA12. This step SA12 is adapted to discharge a copy, to apply postcopying cleaning to the photoconductive drum, etc. Upon the discharge of a copy, the program returns to the wait mode processing of the step SA3.

Figures 1, 10B:
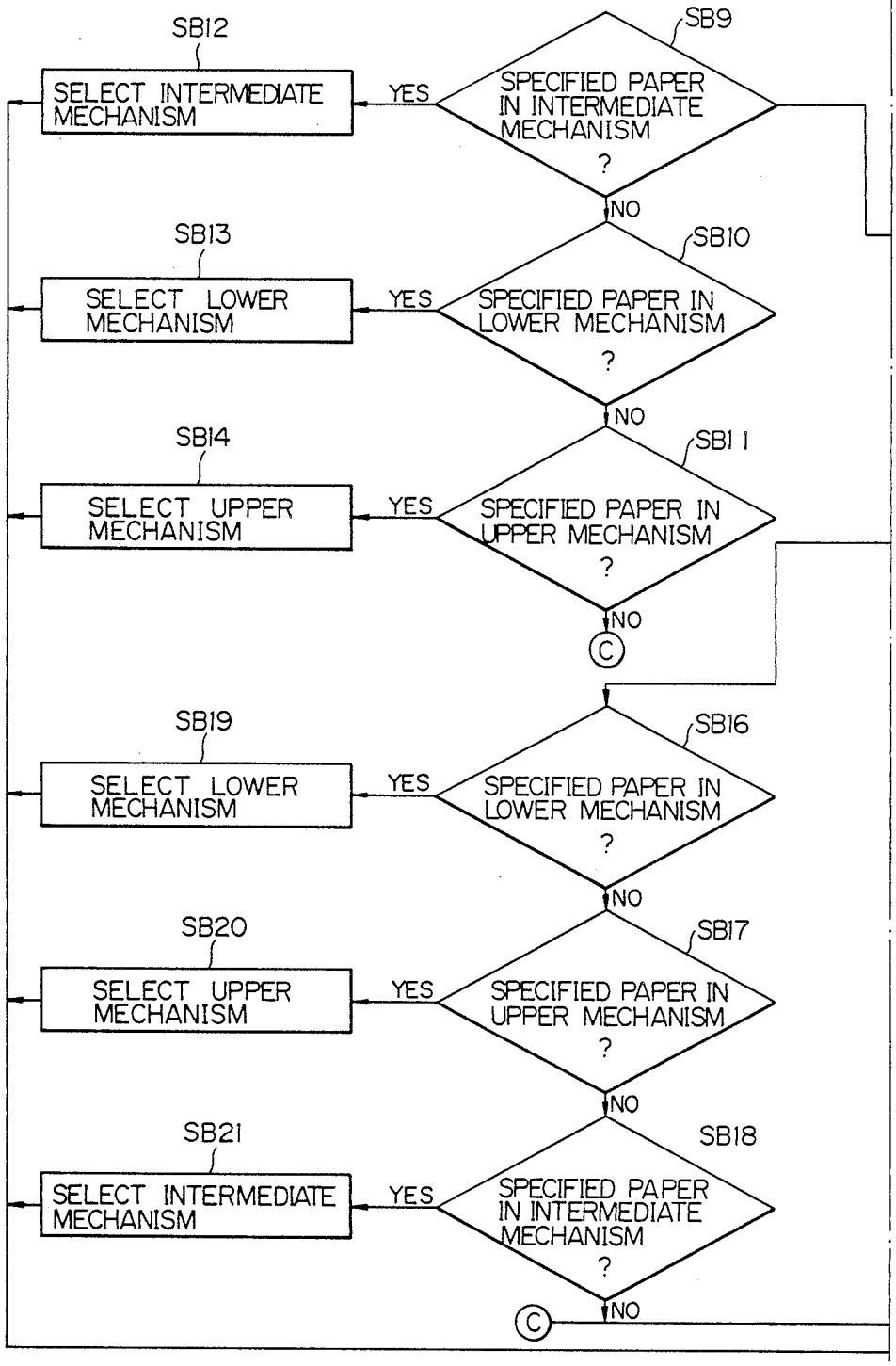

FIG. 10B shows the automatic paper feed selection subroutine of the step SA15 in detail. This subroutine begins with referencing the content of the copy counter Ccopy (step SB1). If the copy counter Ccopy is zero, meaning that paper selection is to occur for the first time, the program advances to a step SB2 and, if otherwise, it advances to a step SB8. When the copy counter Ccopy is zero, the following procedure occurs. First, whether the upper paper feed mechanism 10 is loaded with a paper (recording medium) specified beforehand is determined, i.e., whether the output of the sensor unit S31 (material sensor) and that of the sensor unit S41 (width sensor) which are associated with the mechanism 10 conform respectively to the size and the material specified by the keys K1 and K2 is determined (step SB2). The step SB2 is followed by a step SB5 for selecting the upper paper feed mechanism 10 if such a paper is present in the mechanism 10, and by a step SB3 if otherwise. In the step SB3, whether the intermediate paper feed mechanism 20 is loaded with the specified paper is determined in the same manner. If the mechanism 20 is loaded with such a paper, the program advances to a step SB6 to select the mechanism 20 and, if otherwise, it advances to a step SB4. In the step SB4, as in the SB2, whether the lower paper feed mechanism 30 is loaded with the paper of the specified kind is determined. If the mechanism 30 is loaded with such a paper, a step SB7 is executed to select the mechanism 30 and, if otherwise, a step SB28 is executed to set PAPER END ERROR.

Hereinafter will be described the second paper feed selection and onward. When the copy counter is other than zero, the program is transferred to a step SB8 to see if the upper paper feed mechanism 10 is being selected. If the mechanism 10 is being selected, a step SB9 is executed and if, otherwise, a step SB15 is executed. In the step SB15, whether the intermediate paper feed mechanism 20 is being selected is determined. If the result of this decision is YES, a step SB16 is performed and, if otherwise, i.e., if the lower mechanism 30 is being selected, a step SB22 is executed. In the step SB9, whether the intermediate mechanism 20 is loaded with the paper of the specified kind is determined; if the result is YES, a step SB12 is executed to select the intermediate mechanism 20 and, if it is NO, a step SB10 is executed to see if the lower mechanism 30 is loaded with such a paper. If the result of decision in the step SB10 is YES, the program is transferred to a step SB13 to select the lower mechanism 30 and, if it is NO, the program is transferred to a step SB11. In the step SB11, whether the upper mechanism 10 is loaded with the paper of the specified kind is determined; if the result is YES, a step SB14 is executed to select the upper mechanism 10 and, if otherwise, a step SB28 is executed.

In the step SB16, whether the lower mechanism 30 is loaded with the paper of the specified kins is determined. If it is loaded with such a paper, a step SB19 is executed to select the lower mechanism 30 and, if otherwise, a step SB17 is executed to see if the upper mechanism 10 is loaded with such a paper. If the result of decision in the step SB17 is YES, a step SB20 is executed to select the upper mechanism 10 and, if it is NO, a step SB18 is executed to see if the intermediate mechanism 20 is loaded with the paper of the specified kind. If the intermediate mechanism 20 is loaded with such a paper, a step SB21 is executed to select the mechanism 20 and, if otherwise, a step SB28 is executed. In the step SB22, whether the upper mechanism 10 is loaded with the paper of the specified kind is determined and, if it is loaded with such a paper, a step SB25 is executed to select the upper mechanism 10. If the result of decision in the step SB22 is NO, the program is transferred to a step SB23 to see if the intermediate mechanism 20 is loaded with such a paper. If the result of decision in the step SB23 is YES, a step SB26 is executed to select the intermediate mechanism 20 and, if otherwise, a step SB24 is executed to see if the lower mechanism 30 is loaded with such a paper. If the result of decision in the step SB24 is YES, a step SB27 is executed to select the upper mechanism 10 and, if otherwise, a step SB28 is executed.

More specifically, assume that all of the upper, intermediate and lower paper feed mechanisms 10, 20 and 30 are loaded with a paper of a predetermined kind and, in this condition, the desired number of copies N (large number) is entered on the ten keys KT and stored in the copy number register Nset. When the print start key K4 is pressed to start the first copying operation, the step SB1 is followed by the step SB2 because the instantaneous content of the copy counter Ccopy is zero. Since the upper mechanism 10 is loaded with the paper of the specified kind, the step SB2 is followed by the step SB5 to select the upper mechanism 10. When the second copying operation is performed, the step SB1 is transferred to the step SB8 because the counter Ccopy is not zero then. Since the upper mechanism 10 is being selected, the step SB8 is followed by the step SB9. At this instant, since the intermediate mechanism 20 is loaded with the paper of the particular kind, the step SB9 is transferred to the step SB12 to select the intermediate mechanism 20. In the case of the third copying operation, since the counter Copy is not zero and since the upper mechanism 10 is not being selected, the step SB8 is followed by the step SB15. Since the intermediate mechanism 20 is being selected, the step SB15 is transferred to the step SB16. The lower mechanism 30 is loaded with the desired paper, the step SB19 is executed to select the lower mechanism 30. In the event of the fourth copying operation, since the counter Copy is not zero, since the upper mechanism 10 is not being selected, and since the intermediate mechanism 20 is not being selected either, the step SB15 is followed by the step SB22. At this instant, the upper mechanism 10 is loaded with the desired paper so that the step SB25 is executed to select the upper mechanism 10. Further, at the time of the fifth copying operation, since the counter Ccopy is not zero and since the upper mechanism 10 is being selected, the step SB8 is transferred to the step SB9. Since the intermediate mechanism 20 is loaded with the paper of the particular kind, the step SB12 is executed to select the intermediate mechanism 20.

Thereafter, the procedure described above is repeated. Hence, the paper feed mechanisms 10, 20 and 30 are repetitively selected one after another in this order every time a recording operation is performed, until any of the mechanisms 10, 20 and 30 becomes exhausted. When the intermediate mechanism 20 runs out of the roll, for example, the upper and lower mechanisms 10 and 30 are repetitively selected in this order. As two of the mechanisms 10, 20 and 30 run out of a roll, only the remaining mechanism is used. When all the mechanisms 10, 20 and 30 run out of a roll, PAPER END ERROR is set to inhibit any further copying operation.

Why the paper feed mechanisms 10, 20 and 30 are switched from one to another every time a copying operation is effected is as follows. While a rotary cutter is in rotation, the next paper cannot be fed into the cutter, as stated earlier. Hence, in the case that a paper is fed from the same paper feed mechanism continuously, the paper paid out and cut by a predetermined length cannot be paid out again until the rotary cutter completes one full rotation. In contrast, in the arrangemen wherein the sheet feed mechanisms are each provided with an exclusive cutter and those mechanisms are selected one at a time every time a copying operation is effected, when the cutter of the upper mechanism is in rotation, for example, the next paper feeding procedure can be started with either the intermediate mechanism or the lower mechanism.

Figure 11A:
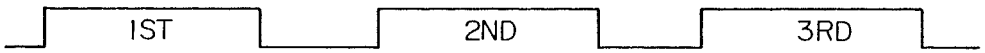
FIGS. 11A and 11B exemplarily show the waveforms of signals which are outputted by the individual sensor units.
Figure 11B:
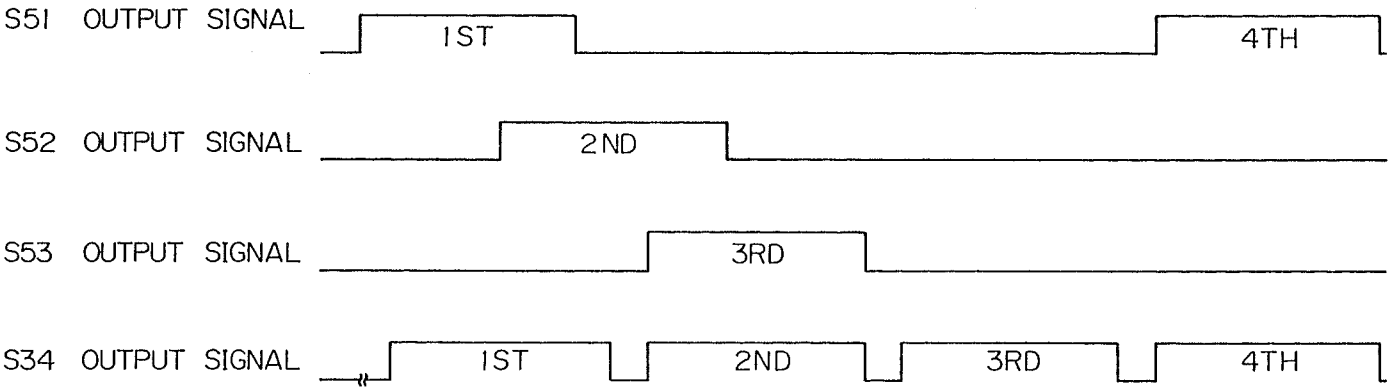

FIG. 11A shows the waveform of an output signal of the sensor unit S34 (high level being representative of a condition wherein the transport of a paper is under way) appearing when the paper feed operation is continuously repeated with a single paper feed mechanism. FIG. 11B shows the waveforms of the sensor units S51, S52, S53 and S54 (high level being representative of a condition wherein the transport of a paper is under way) appearing when the paper feed operation is continuously repeated with the upper, intermediate and lower paper feed mechanisms 10, 20 and 30. By comparing the two different waveforms S34, it will be clear that the interval between the consecutive paper feed operations, i.e., waiting time is shorter in FIG. 11B than in FIG. 11A.

In summary, it will be seen that the present invention provides a rolled recording medium feeding device for an image recording apparatus which eliminates the delay of the subsequent paper feed operation otherwise needed to await the end of rotation of a rotary cutter, thereby increasing the average paper feed speed during continuous paper feed mode operation.

What is claimed is:

1. A device installed in an image recording apparatus for feeding a rolled recording medium, comprising:

a plurality of recording medium feeding means each comprising pulling means for pulling the leading edge of a rolled recording medium onto a predetermined transport path by holding a part of said recording medium, driving means disposed on said transport path for driving said pulling means, and cutting means for cutting said recording medium along an axis which is substantially perpendicular to an intended direction of recording medium feed;

control means for controlling said recording medium feeding means such that said recording medium feeding means for pulling out the recording medium are switched from one to another every time an operation for feeding the recording medium occurs; and sensing means for sensing a kind of the recording medium which is loaded in associated one of said recording medium feeding means, said control means being constructed such that any of said recording medium feeding means which are loaded with the recording medium of a kind specified beforehand are identified on the basis of outputs of said sensing means, said recording medium feeding means loaded with the recording medium of said particular kind are switched from one to another every time an operation for feeding the recording medium occurs, and the switching is inhibited when the recording medium of said particular kind is not accommodated in a plurality of said recording medium feeding means.

2. A device as claimed in claim 1, wherein said control means is further constructed to inhibit the switching when any of said recording medium feeding means is specified.

* * * * *